US009440139B1

(12) United States Patent
Feola

(10) Patent No.: US 9,440,139 B1
(45) Date of Patent: Sep. 13, 2016

(54) METHOD OF PLAYING A BONUS

(75) Inventor: John Feola, North Reading, MA (US)

(73) Assignee: New Vision Gaming & Development, Inc., North Reading, MA (US)

( * ) Notice: Subject to any disclaimer, the term of this patent is extended or adjusted under 35 U.S.C. 154(b) by 832 days.

(21) Appl. No.: 13/092,111

(22) Filed: Apr. 21, 2011

Related U.S. Application Data

(60) Division of application No. 11/829,675, filed on Jul. 27, 2007, now abandoned, which is a continuation-in-part of application No. 11/305,175, filed on Dec. 17, 2005, now Pat. No. 7,270,331.

(51) Int. Cl.
*A63F 1/00* (2006.01)

(52) U.S. Cl.
CPC ..... *A63F 1/00* (2013.01)

(58) Field of Classification Search
CPC ..... A63F 1/00
USPC ..... 273/292
See application file for complete search history.

(56) References Cited

U.S. PATENT DOCUMENTS 6,070,873 A * 6/2000 Perkins ..... 273/292
6,227,969 B1 * 5/2001 Yoseloff ..... 463/13
6,234,485 B1 * 5/2001 Perkins ..... 273/292
6,299,170 B1 * 10/2001 Yoseloff ..... 273/292
6,419,578 B1 * 7/2002 Moody et al. ..... 463/13
6,481,717 B1 * 11/2002 Richardelle ..... 273/292
6,607,195 B2 * 8/2003 Vancura ..... 273/274
6,659,461 B2 * 12/2003 Yoseloff et al. ..... 273/274
6,789,801 B2 * 9/2004 Snow ..... 273/292
6,808,174 B1 * 10/2004 Rubin ..... 273/292
6,869,076 B1 * 3/2005 Moore et al. ..... 273/292
7,032,902 B1 * 4/2006 Yuan ..... 273/274
7,128,645 B1 * 10/2006 White et al. ..... 463/13
7,144,321 B2 * 12/2006 Mayeroff ..... 463/16
7,270,331 B1 * 9/2007 Feola ..... 273/292
7,344,136 B2 * 3/2008 Schultz ..... 273/292
7,731,582 B2 * 6/2010 Randall et al. ..... 463/20
2006/0240885 A1 * 10/2006 Thomas et al.
2006/0276242 A1 * 12/2006 Thomas et al. ..... 463/11
2007/0060247 A1 * 3/2007 Low et al. ..... 463/16

* cited by examiner

*Primary Examiner* — Gene Kim
*Assistant Examiner* — Dolores Collins
(74) *Attorney, Agent, or Firm* — Altman & Martin; Steven K Martin

(57) ABSTRACT

A method of playing a game bonus triggered by the rank of the player hand. In a first embodiment, a number of bonus hands is displayed, each assigned a bonus value. A number of bonus hands are chosen, the number chosen being dependent on the rank of the player hand. The values of the chosen bonus hands are revealed. Alternatively, a number of bonus hands is displayed, the number being dependent on the rank of the player hand. After the bonus values are revealed, the player is paid an amount based on the bonus values.

9 Claims, 6 Drawing Sheets

| Poker Hand | Value |
|---|---|
| Royal Flush | 50 |
| Straight Flush | 25 |
| Four of a Kind | 10 |
| Full House | 5 |
| Flush | 2 |
| Straight | 1 |

METHOD OF PLAYING A BONUS

CROSS-REFERENCES TO RELATED APPLICATIONS

The present application is a divisional application of application Ser. No. 11/829,675, filed Jul. 27, 2007 now abandoned for METHOD OF PLAYING A BONUS in the name of John Feola, which is a continuation-in-part application of application Ser. No. 11/305,175, filed Dec. 17, 2005 now U.S. Pat. No. 7,270,331 for METHOD OF PLAYING A BONUS in the name of John Feola.

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to gaming, more particularly, to a bonus for casino, lottery, and bingo games.

2. Description of the Related Art

Many games, such as casino card games, have side or bonus bets. In the typical side bet, a player wagers that the ranking of a predetermined set of cards that are dealt during the game will be found in a pay table. The side bet may be independent of the game, so a player may win one but not the other. Side bets and bonuses are popular because they add excitement to a game and increase its potential without adding much extra time to the game play.

BRIEF SUMMARY OF THE INVENTION

An object of the present invention is to provide a bonus triggered by the outcome of a game.

Another object is to provide a bonus that is itself fun to play and that adds interest to the game.

The present invention is a bonus adjunct to a game that is triggered when the player hand has a certain minimum rank. In one embodiment, the player is presented with two or more bonus hands from which to choose. Each bonus hand has a value associated with it that, optionally, guarantees the player a bonus payout regardless of the choice. The value may be an absolute amount or it may be a multiplier. A multiplier determines the payout as a multiple of the amount the player won for the player hand that triggered the bonus.

Markers initially represent the bonus hands so the payout values are hidden. The player chooses bonus hands from the markers presented. The number of bonus hands the player can choose is determined by the rank of the player hand that triggered the bonus. After a bonus hand is chosen, its value is revealed. The payout amount may be directly revealed or a representation of the payout amount may be revealed, for example, a poker hand, where the poker hand rank is directly related to the value.

Alternatively, the bonus hands are represented by wheels that have a set of possible values. The sets of possible values may be same or different for each of the wheels. The chosen wheels spin to result in the bonus value for those wheels.

Values are assigned to the bonus hands from a pool of possible values, called selections. Each selection has only one value, but more than one selection may have the same value. In one method, there are the same number of selections as there are bonus hands, and the selections are randomly assigned. In another method, there are more selections in the pool than there are bonus hands, and each of the bonus hands is randomly assigned one of the selections from the pool.

In the second embodiment, the player is awarded a number of bonus hands, the number of which is dependent on the rank of the player hand.

In the third embodiment, the player is presented with a bonus wheel with a set of possible bonus values. The bonus wheel is spun one or more times, the number of times being dependent on the rank of the player hand.

In the fourth embodiment, the bonus hands are displayed as matrix of playing cards. Hands are made from each row, column, and diagonal of card locations. The player chooses a hand by selecting a button representing the desired hand, after which the chosen hand is revealed.

The bonus of the present invention may be played in a number of different environments, including, but not limited to, table games, video poker, video keno, lottery-style keno, and slot machines.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
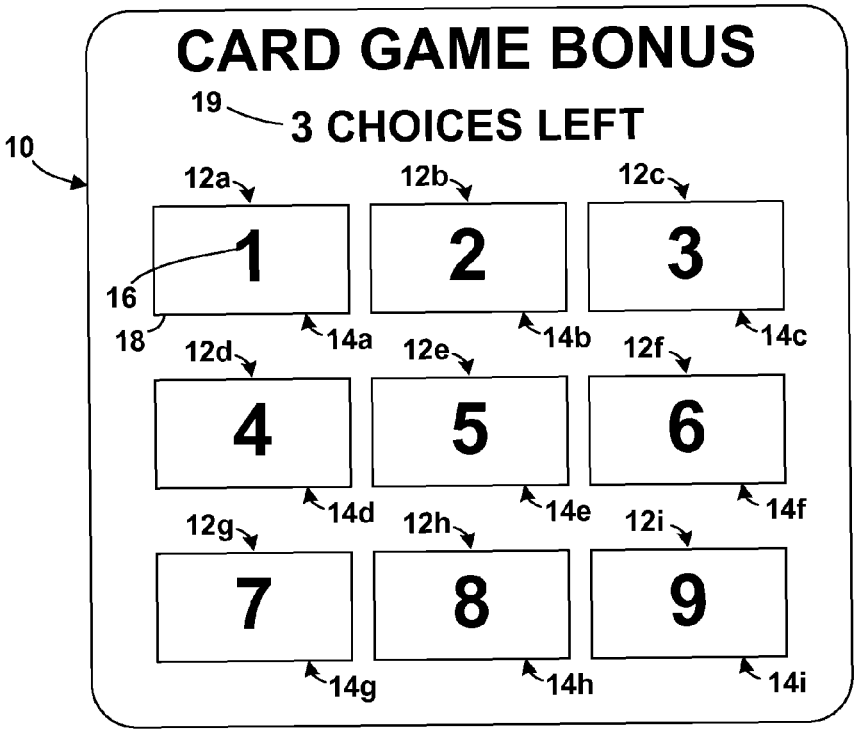
FIG. 1 shows an example of one form of the first embodiment of the present invention.

The present invention is a bonus adjunct to a game where a player wins more if certain events occur. An example of a game with which the bonus of the present invention can be used is disclosed in U.S. Pat. No. 5,664,781. In the game of the '781 patent, a player chooses one or more of a plurality of player hands, and the player wins if one of the chosen player hands is the highest ranked of the player hands.

The games with which the present invention can be used can be played live, as in a casino table game with paper playing cards or a bingo game with bingo balls and paper cards, or the game can be virtual, as in video poker or video slots, where cards and wheels are images on a video screen. The same is true of the present invention.

Typically, a player participating in a game automatically participates in a bonus, that is, a player does not have to pay an additional amount to participate in the bonus. This is the preferred embodiment of the present invention. However, the present invention contemplates that the player must wager an additional amount to participate in the bonus.

The bonus of the present invention is triggered by the occurrence of a predetermined triggering event. One such predetermined triggering event is when a player hand has a predetermined rank. What constitutes a player hand and its rank depends on what the game is. The bonus of the present invention works most easily in a video environment, but can work with any type of game on any type of media where there is a set of cards or other tokens that makes up a hand that can have a predetermined combination or rank. The following examples are illustrative only and are not intended to be an exhaustive list. In card games, like video poker, the player hand is the combination of cards, the rank is the particular combination of cards, and the bonus is triggered if the rank has a predetermined value. In keno, the player hand is the numbers picked by the player, the quantity of correct numbers is the rank, and the bonus is triggered if the player picks a predetermined minimum number of correct numbers. On a slot machine, the combination of symbols that the wheels stop on is the hand, the particular combination of symbols is the rank, and the bonus is triggered if the rank has a predetermined value. In bingo, the hand is the type of bingo (e.g., five in a row, a diagonal, four corners, etc.), the rank is the number of spaces covered to reach the bingo, and the bonus is triggered if the player gets bingo with a predetermined minimum number of covered spaces. Alternatively, the rank is the number of spaces drawn to reach the bingo, and the bonus is triggered if the player gets bingo with a predetermined minimum number of draws.

As indicated above, the bonus is triggered when the player hand has a predetermined rank. In poker, for example, if the player hand has a full house or better, the bonus is triggered. In one embodiment of the present invention, the rank of the winning player hand triggers the bonus. In another embodiment, any player hand that is of a predetermined rank triggers the bonus, whether or not the hand is the winning player hand. In yet another embodiment, the bonus is triggered randomly, that is, the rank of a player hand does not determine if the bonus will be triggered; the occurrence of a random event triggers the bonus.

Another possible trigger is the end of the game. For example, if the game is keno, the bonus can be triggered after all the keno numbers are drawn. Because each keno game is generally played by hundreds or even thousands of people, the chance that someone will get a predetermined minimum hand rank that would ordinarily trigger the bonus is high. So rather than disrupt the consistent sequence and timing for each keno game, the bonus is always triggered. Alternatively, the bonus is triggered only every certain number of games. For example, the bonus game is only triggered every fifth keno game, regardless of whether any player has the predetermined minimum hand rank for any of the other four out of five games.

Typically, the bonus of the present invention is triggered after the hands are revealed and the payouts for the game are distributed appropriately. Alternatively, the bonus is triggered after all of the player hands are revealed and the winning hand is determined, but before payouts are made.

The bonus is displayed whenever it is convenient or desirable. Displaying of the bonus is independent of initiating the bonus. Initiation is when the focus of the player moves from the game to the bonus. The bonus may be displayed constantly, but is only initiated after it is triggered. For example, in video poker, if the player hand has a triggering rank and the game is complete, the poker game is cleared from the screen and the bonus is displayed and initiated. In this case display and initiation occur at the same time. In another example, in lottery-style keno, the bonus may be displayed alongside the keno game, but is only initiated when the keno game is complete, that is, when all the numbers are drawn.

The bonus of the present invention has two general embodiments. In one embodiment, the player is presented with a plurality of bonus hands from which either he can choose one or more or one or more are chosen for him. The number to be chosen depends on some criteria, such as the rank of the player hand. In the second embodiment, the player is awarded a number of bonus hands, where the number of bonus hands depends on some criteria, such as the rank of the player hand. There is nothing to choose, since all of the awarded bonus hands belong to the player.

In the first embodiment, an example of one form of which is shown in FIG. 1, the player is presented with a bonus display 10 showing two or more bonus hands 12*a*-12*i* (collectively, 12), each represented by a marker 14*a*-14*i* (collectively, 14). The present invention does not provide an upper limit to the number of bonus hands 12, although there may be practical considerations. The number of bonus hands 12 is generally fixed from game to game, that is, the same number of bonus hands 12 will always be displayed.

Every bonus hand 12 has a value associated with it. Typically, the value will be greater than zero, meaning that the player is guaranteed a bonus payout with something of value regardless of the choice, but other values are contemplated. Bonus values can be zero, where the player wins nothing more, or negative, where the player's payout from the game is reduced.

The bonus hands 12 will typically have different values, and it is up to the player to choose the bonus hand 12 that she believes has the highest value in order to maximize her winnings. The bonus value may be an absolute amount or it may be a multiplier. With an absolute amount, the payout amount that the player receives is the value shown or represented, for example, $5, a voucher, or a stuffed animal. With a multiplier, the payout amount that the player receives is the value times the amount the player received for the player hand that triggered the bonus. For example, if the value is 5×, the player receives a payout amount that is 5 times the amount won by the player for the player hand. Unless otherwise indicated, references in the present specification to bonus values include both absolute amounts and multipliers.

Markers 14 initially represent the bonus hands 12 so that the values are hidden. In the example of FIG. 1, there are nine markers 14*a*-14*i*, each represented by a unique number 16 in a box 18. Any form of marker 14 that allows the player to uniquely identify a bonus hand 12 can be used. The markers 14 can take many different forms. For example, the markers 14 can be unique people, animals, plants, or other objects, they can be geometric figures, etc. Video permits animated markers.

The player chooses a bonus hand 12 from the markers 14 presented. Optionally, the player can choose more than one bonus hand 12. Optionally, the number of bonus hands 12 that the player is permitted to choose depends upon the rank of the player hand. For example, if the player hand has a straight, the player can choose one bonus hand 12, but if the player hand has four of a kind, the player can choose three bonus hands 12. The number of bonus hands 12 the player is permitted to choose is displayed in some manner, as at 19. The present invention contemplates that any manner of choosing the bonus hand or hands 12 can be employed, including, for example, a touch screen, a keypad, a keyboard, etc.

Figure 2:
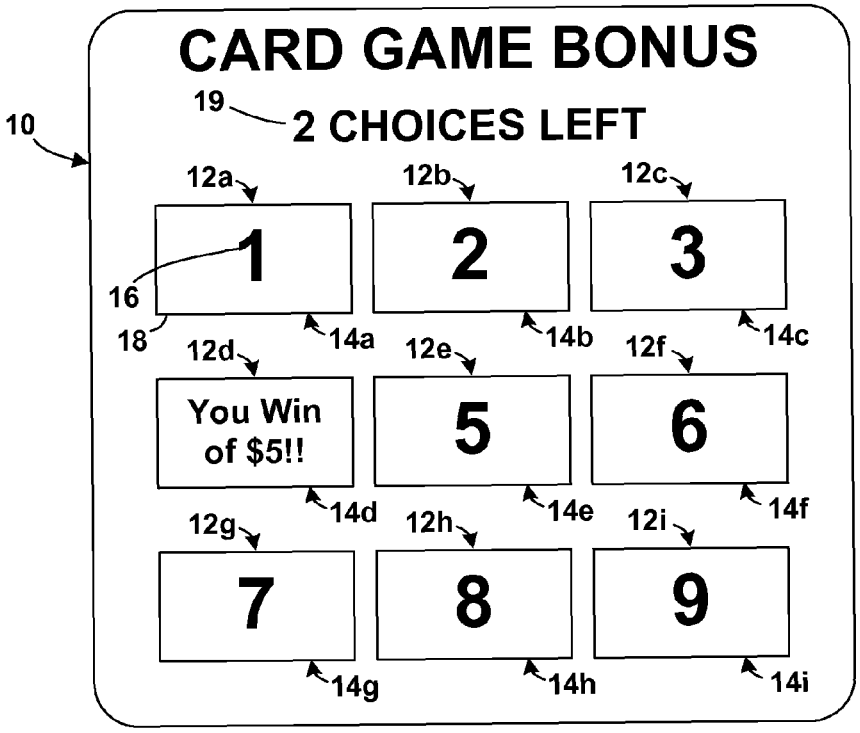
FIG. 2 shows an example display of FIG. 1 after the chosen bonus hand is revealed.

After a bonus hand 12 is chosen, its value is revealed. In one form, the value is directly revealed as a payout amount. An example of such a form is shown in FIG. 2, where the player chose bonus hand 4 12*d*, which was revealed as having a $5 payout amount. When more than one bonus hand 12 is chosen, the total bonus payout may be the payout amount of the highest-ranked bonus hand 12 or some combination of the payout amounts of all the chosen bonus hands 12.

Figures 3, 4:
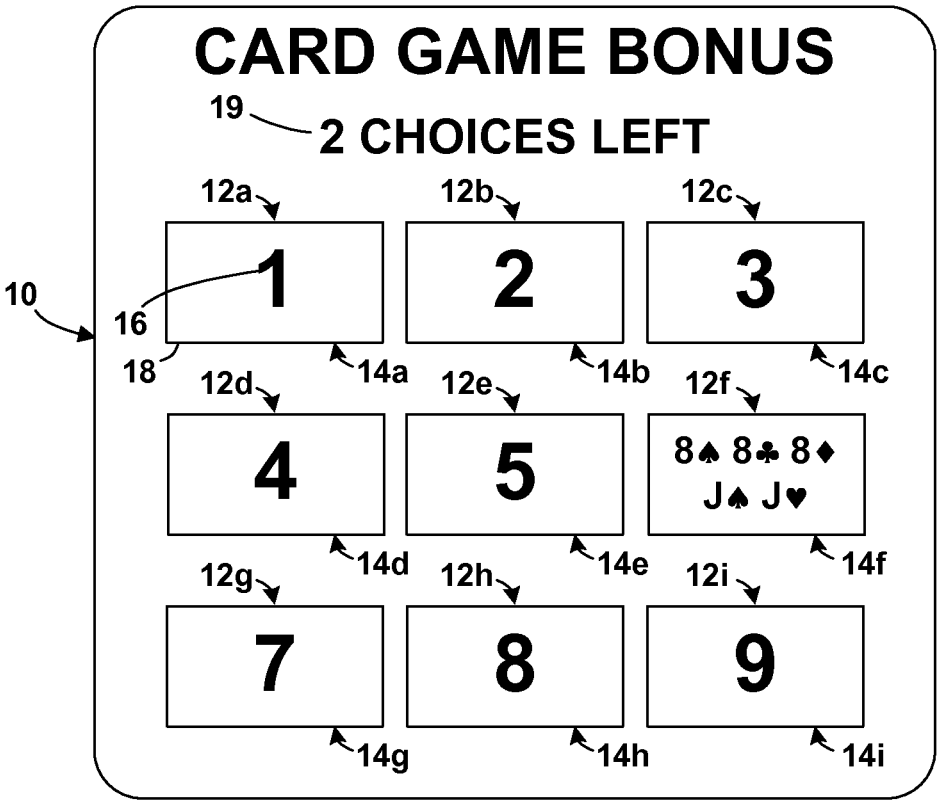
FIG. 3 shows another example display of FIG. 1 after the chosen bonus hand is revealed.
FIG. 4 is an example table of bonus poker hands with corresponding values.

In another form, a poker hand representing the value, rather than the value itself, is revealed. An example is shown in FIG. 3, where the player chose bonus hand 6 12*f*, revealing a full house consisting of 8 of spades, 8 of clubs, 8 of diamonds, jack of spades, and jack of hearts. Typically, there are five or seven cards in the poker hand. The present invention, however, contemplates that there may be as few as two cards in each poker hand. Typically, the rank of the poker hand is directly related to the value, that is, the higher the rank, the greater the value. An example of such a relationship is shown in the table of FIG. 4. For the example of FIG. 3, the player receives $5, the payout amount represented by a full house. Typically, the poker hand for each bonus hand is unique, although there may be multiple poker hands with the same rank, and hence the same value. In other words, for example, there may be a number of poker hands with a straight, but each poker hand has a different straight. The payout amount may be revealed with the poker hand so the player does not have to consult a table to know what the payout amount is for the revealed hand.

Figure 5:
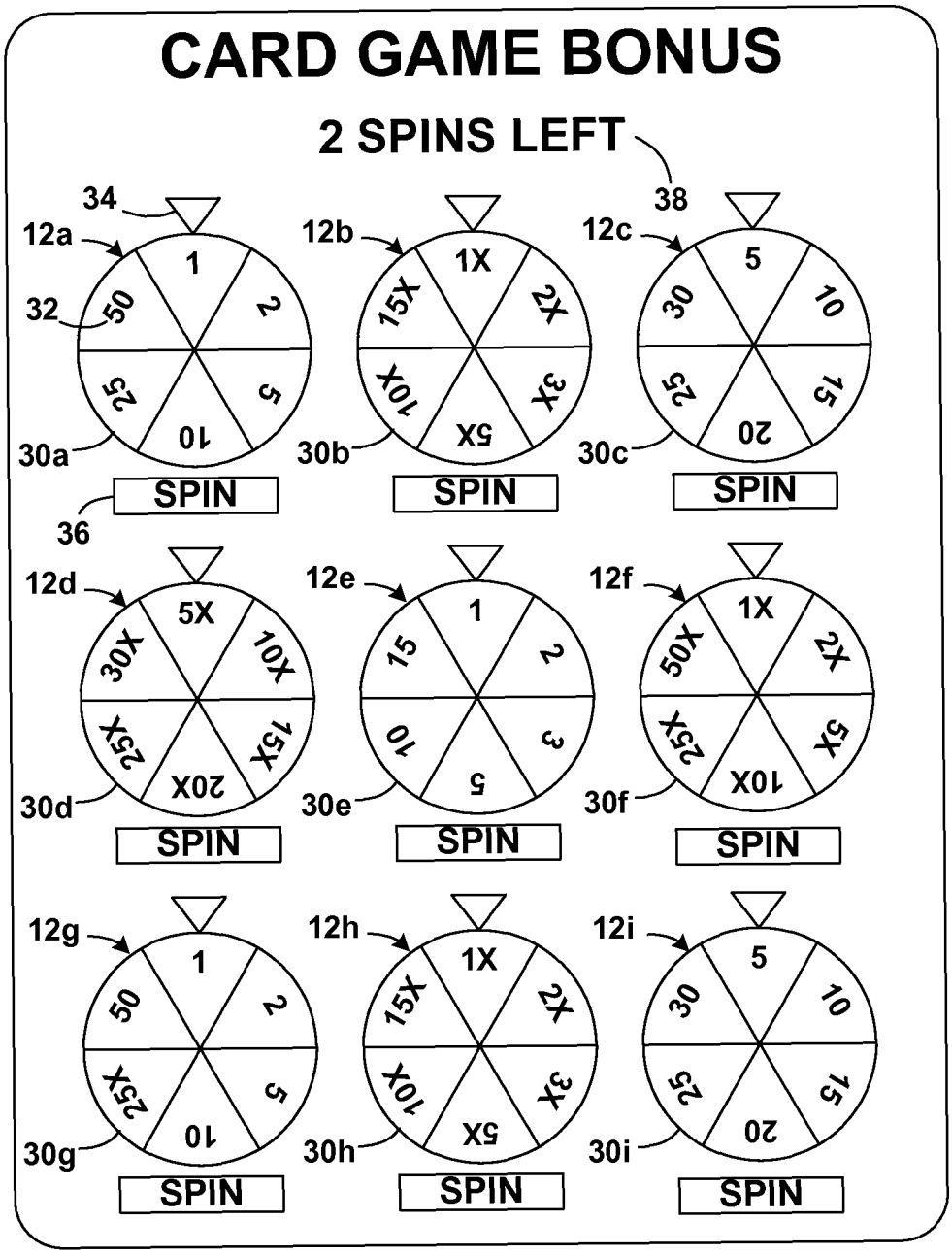
FIG. 5 shows an example of another form of the first embodiment of the present invention.

In yet another form, an example of which is shown in FIG. 5, the bonus hands 12 are represented by wheels 30*a-i* (collectively, 30). Each wheel 30 has a set of possible values 32. The wheels 30 of FIG. 5 shows six possible values 32, but the present invention contemplates that there can be any number of possible values 32. The sets of possible values 32 may be same for all of the wheels 30, different for all the wheels 30, or there may be some combination of both. Likewise, the possible bonus values 32 may change from game to game. Unlike the embodiment of FIG. 1, the possible values 32 may be hidden or exposed. They can be exposed because the wheel 30 is spun prior to displaying its actual bonus value. As with the configuration of FIG. 1, the possible values 32 can be absolute amounts representing direct payouts or multipliers.

Each wheel 30 is spun to display its bonus value. The wheel 30 can be spun by the player by, for example, touching a SPIN button 36, touching the wheel 50 itself, or any other manner that is appropriate. Alternatively, the wheel 30 is spun automatically without requiring the player to initiate the spin. When the wheel 30 stops spinning, the possible value 32 indicated by the arrow 34 is revealed as the bonus value for that bonus hand 12.

In some games, it is possible to have multiple triggers. For example, each keno game is generally played by hundreds or even thousands of people, and the chances that more than one person will get a triggering hand and triggering hands of different ranks are high. Consequently, permitting each player with a triggering hand to make his individual bonus hand choices is not practical.

One way in which the present invention handles this issue is by revealing all of the bonus values and assigning certain ones of the bonus values to each triggering hand rank. The assignments can be fixed, that is, the same bonus hands are assigned to each triggering hand rank. For example, using the display of FIG. 1, for a player hand with four correct numbers, the bonus hands will always be hands 12*a*, 12*d*, and 12*g*, and for a player hand with six correct numbers, the bonus hands will always be hands 12*a*, 12*c*, 12*e*, 12*g*, and 12*i*. Alternatively, bonus hand assignments can be random, that is, they change from game to game. For example, using the display of FIG. 1, for a player hand with four correct numbers, the three bonus hands may be randomly determined to be 12*a*, 12*f*, and 12*h* for one game and 12*c*, 12*e*, and 12*i* for the next game.

In order for the players to know which bonus hands 12 are assigned to each player hand rank, each bonus hand 12 is annotated in some way. For example, a numeral can be shown in each bonus hand indicating that the bonus hand is assigned to a player hand rank, e.g., the numeral 5 in a bonus hand can indicate that it is assigned to the player hand rank of five correct numbers. Alternatively, colors or other visual indicia can be used.

The present invention contemplates several different methods for assigning values to the bonus hands 12. In general, values are assigned from a pool of potential values, called selections. Each selection has only one value, but more than one selection may have the same value. In an example, a pool of 25 selections has 14 $2 values, seven $5 values, three $10 values, and one $25 value.

When the selections are poker hands that represent values, the combination of cards that make up each poker hand selection may be the same from game to game or they may be generated for each game. For example, if two selections are straight flushes, the same two straight flushes may be used every time the bonus is triggered, or different straight flushes may be generated each time the bonus is triggered.

In one method of assigning values, there are the same number of selections as there are bonus hands. The selections are randomly assigned to the bonus hands, where a selection is assigned only once, so that all the selections are assigned. Sometime before the chosen bonus hand or hands are revealed, the nine selections are randomly assigned to the nine bonus hands. With this method, the same number of each value will be available every time the bonus of the present invention is played. In one example, there are nine bonus hands and nine possible selections: five $2 payouts, three $5 payouts, and one $10 payout. Every one of the nine selections are available every time the bonus is triggered.

In another method, there are more selections in the pool than there are bonus hands. Sometime before the chosen bonus hand or hands are revealed, each of the bonus hands is randomly assigned one of the selections from the pool, where each selection is assigned only once. In one example, there are nine bonus hands and 30 possible selections: 15 $2 values, eight $5 values, four $10 values, two $25 values, and one $50 value. Because there are nine bonus hands, there will always be nine selections assigned, but precisely which nine selections of the 30 that are assigned each time the bonus is triggered is random.

Figure 6:
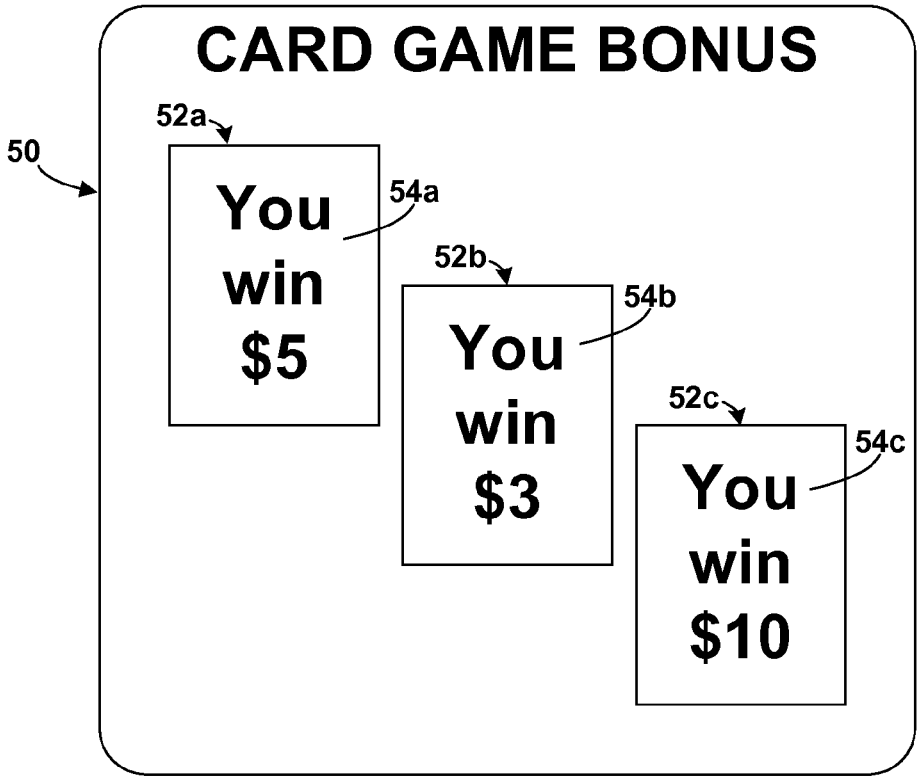
FIG. 6 shows an example of a form of the second embodiment of the present invention.

In the second embodiment of the present invention, an example of one form of which is shown in FIG. 6, the player is presented with a bonus display 50 showing two or more bonus hands 52*a*-52*c* (collectively, 52). The number of bonus hands 52 varies depending on one or more different factors, such as the rank of the player hand that triggered the bonus. For example, if the player hand is a full house, three bonus hands 52 are displayed, as in FIG. 6. A different player hand rank may cause a different number of bonus hands 52 to be displayed.

As with the first embodiment, every bonus hand 52 has a value 54*a*-54*c* (collectively, 54) associated with it. The value can be greater than zero, zero, or negative. The value may be an absolute amount or it may be a multiplier.

Because all of the bonus hands 52 belong to the player, there is no need to hide the values, as in the first embodiment. Consequently, the bonus hand values 54 can be displayed when the bonus is triggered. When there is more than one bonus hand 52, the total bonus payout may be the payout amount of the highest-ranked bonus hand 52 or some combination of the payout amounts of all the bonus hands 52.

Figure 7:
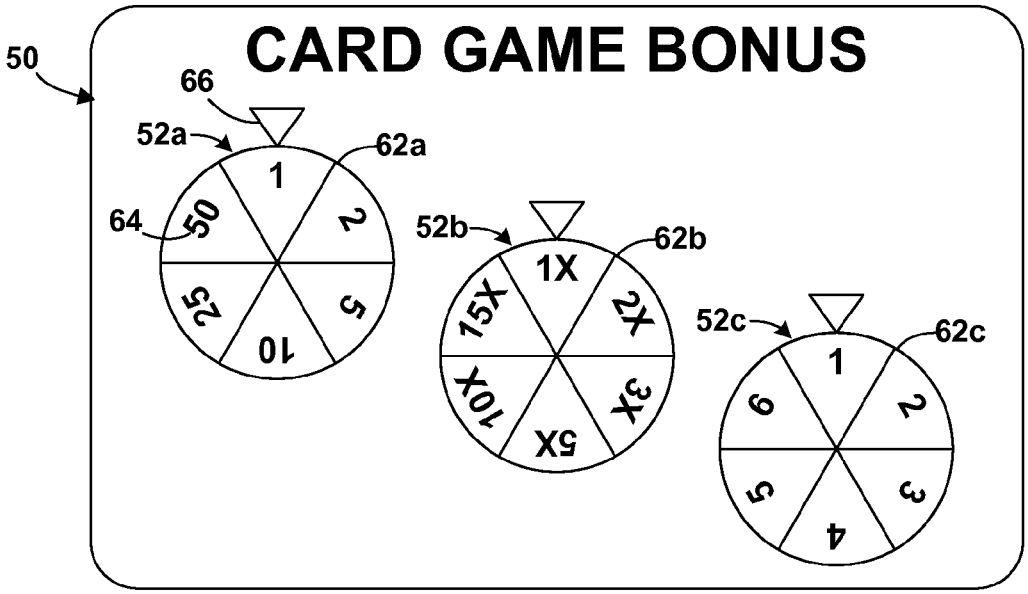
FIG. 7 shows an example of another form of the second embodiment of the present invention.

In another form of the second embodiment, an example of which is shown in FIG. 7, the bonus hands 52 are represented by wheels 62*a-c* (collectively, 62), each with a set of possible values 64 that may be hidden or exposed. As with the embodiment of FIG. 5, the bonus wheels 62 may have the same or different sets of possible values 64.

Because all of the bonus hands 53 belong to the player, there is no need for the player to proactively spin the wheels 62. In this scenario, when the bonus is triggered, the wheels 62 are spun automatically. The bonus value is denoted by the arrow 66 when the wheel 62 stops spinning. The present invention does contemplate that the player will be allowed to explicitly spin each wheel 62.

Figure 8:
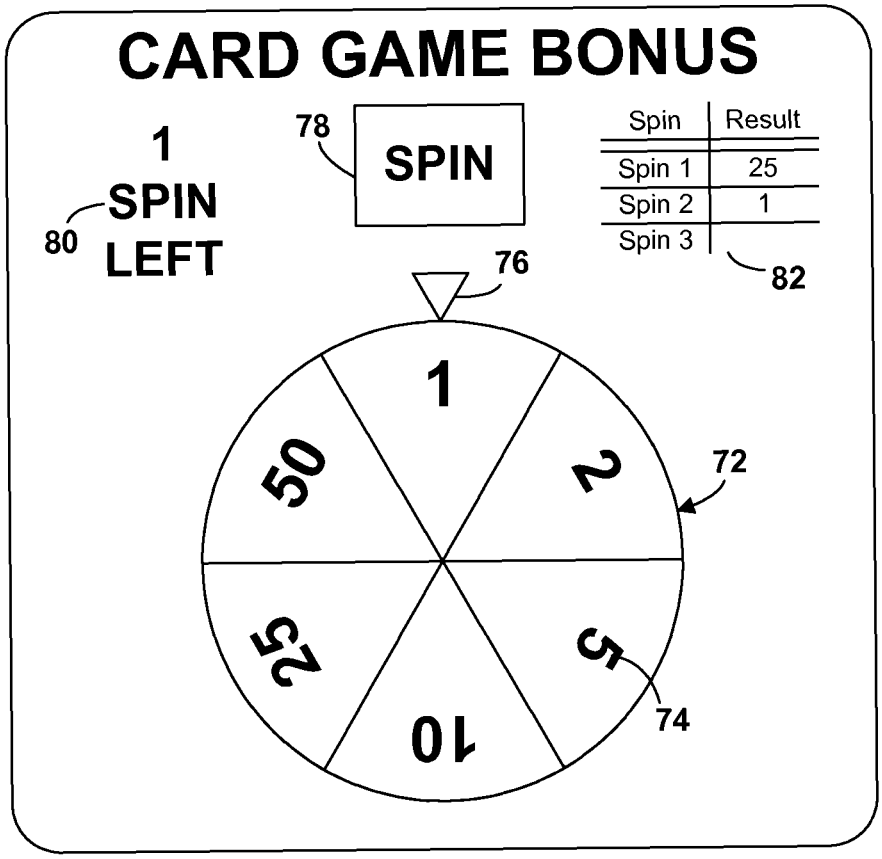
FIG. 8 shows an example of the third embodiment of the present invention.

Another embodiment of the bonus of the present invention is shown in FIG. 8. Rather than displaying a plurality of bonus hands, the player is presented with a single bonus wheel 72 with a set of possible bonus values 74. The bonus wheel 72 of FIG. 5 shows six values 74, but the present invention contemplates that there can be any number of values 74. Unlike the embodiment of FIG. 1, the values 74 may be hidden or exposed. The values 74 can be exposed because the wheel 72 is spun in order to determine the actual bonus value. As with the other embodiments, the bonus values 74 can be absolute amounts representing direct payouts or multipliers.

The bonus wheel 72 is spun one or more times, the number of times being dependent on the rank of the player hand. An arrow 76 points to the spin result and, if not already exposed, the bonus value for that spin is revealed. In one form, the player initiates the spin. The present invention contemplates that any manner can be used for the player to initiate a spin. In the example of FIG. 8, the player touches a SPIN button 78. There is also a field 80 that displays the number of spins the player has remaining. If the player has more than one spin, the results of all the spins are displayed, as at 82. Alternatively, the wheel 72 can be spun automatically when the bonus is triggered. Using the keno example above when multiple players trigger the bonus, the wheel 72 can by spun automatically the appropriate number of times, with the results of each spin being displayed, as at 82. Each player entitled to a bonus received the results of the corresponding number of spins. For example, if the player got three numbers correct, he is entitled to the bonus from the first spin, and if the player got five numbers correct, he is entitled to the bonus from the first three spins.

Figure 9:
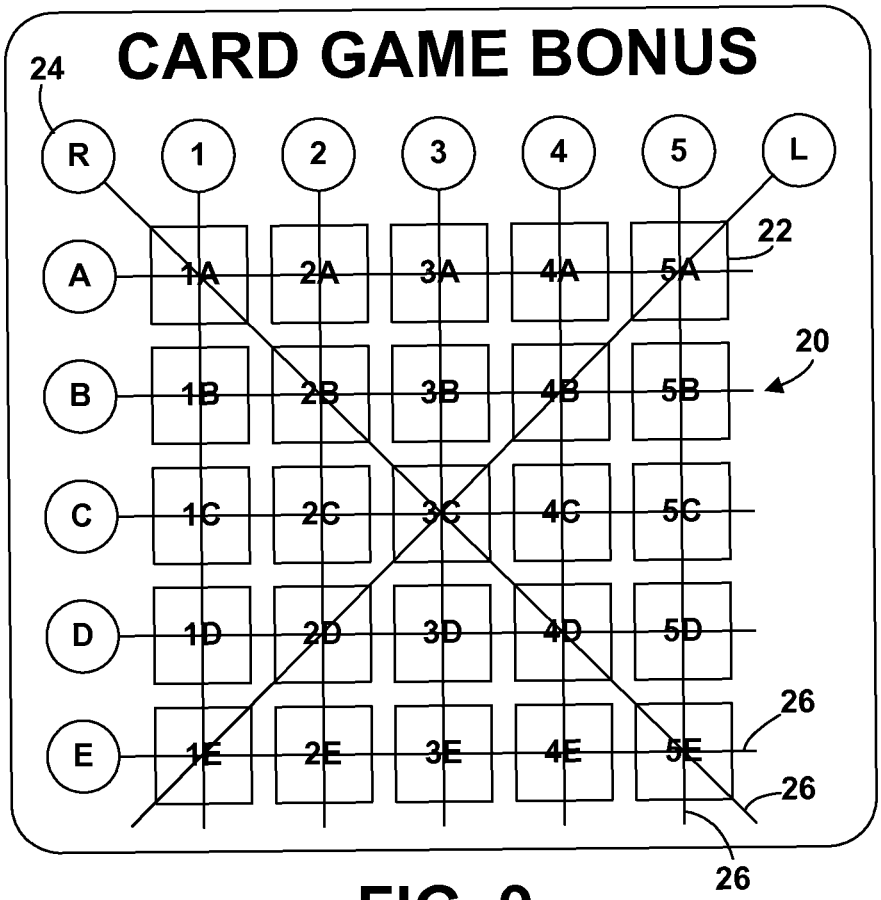
FIG. 9 is an example display of fourth embodiment of the present invention.

Another embodiment of the bonus of the present invention is shown in FIG. 9. Rather than displaying a plurality of bonus hands, this embodiment displays a matrix 20 of locations 22, where each location 22 represents a playing card. In the example of FIG. 8, the matrix 20 is five cards by five cards. It is possible to make 12 rows of five cards from this matrix (five across, five down, and two diagonally. The player chooses a hand by selecting the button 24 representing the desired hand, as shown lines 26. After the button 24 is selected, the cards of the chosen hand are revealed. Alternatively, the hands can be chosen randomly by the system. In such an scenario, the cards at each locations can be shown face up.

Thus it has been shown and described a game bonus which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A method of playing a bonus to a keno-type game comprising the steps of:

(a) displaying said keno-type game on a video screen during game play, a player having a player hand with a rank at the end of said game play;

(b) displaying a plurality of bonus hands on said video screen;

(c) assigning a corresponding bonus value to each of said bonus hands;

(d) choosing a number of said bonus hands as chosen bonus hands, said number depending on said player hand rank;

(e) displaying said corresponding bonus value for each of said chosen bonus hands on said video screen; and (f) paying said player said corresponding bonus value of at least one of said chosen bonus hands.

2. The method of claim 1 further comprising receiving a wager from said player to participate in said bonus.

3. The method of claim 1 wherein said bonus hands are represented by wheels displayed on said video screen.

4. The method of claim 3 wherein each of said wheels has a plurality of possible bonus values that includes said corresponding bonus value and said corresponding bonus value is revealed after said wheel is spun.

5. The method of claim 1 wherein said corresponding bonus values are assigned randomly from a pool of selections.

6. The method of claim 1 wherein said corresponding bonus values are absolute values.

7. The method of claim 1 wherein said corresponding bonus values are multipliers.

8. The method of claim 1 wherein said chosen bonus hands are predetermined.

9. The method of claim 1 wherein said player is paid said corresponding bonus value of only one of said chosen bonus hands.

* * * * *